US007839359B2

(12) United States Patent
Choi et al.

(10) Patent No.: US 7,839,359 B2
(45) Date of Patent: Nov. 23, 2010

(54) PLASMA DISPLAY APPARATUS AND METHOD OF DRIVING THEREOF

(75) Inventors: Yoonchang Choi, Milyang-si (KR); Jung Gwan Han, Gumi-si (KR); Chi Yun Ok, Gumi-si (KR); Hyun Lark Do, Daegu (KR); Kyoung Jin Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 867 days.

(21) Appl. No.: 11/619,647

(22) Filed: Jan. 4, 2007

(65) Prior Publication Data

US 2007/0188410 A1 Aug. 16, 2007

(30) Foreign Application Priority Data

Feb. 16, 2006 (KR) ..... 10-2006-0015341

(51) Int. Cl.
*G09G 3/28* (2006.01)

(52) U.S. Cl. ..... 345/60; 345/61

(58) Field of Classification Search ..... 345/60–67, 345/204, 211; 315/169.1–169.4; 313/581–584, 313/590

See application file for complete search history.

(56) References Cited

U.S. PATENT DOCUMENTS 6,529,177 B2 * 3/2003 Nakamura ..... 345/60
7,126,561 B2 * 10/2006 Lim ..... 345/60
7,355,568 B2 * 4/2008 Homma ..... 345/60
2005/0077836 A1 4/2005 Jin
2006/0262043 A1 * 11/2006 Homma ..... 345/67
2008/0211795 A1 * 9/2008 Homma ..... 345/204

FOREIGN PATENT DOCUMENTS

| | | | |
|---|---|---|---|
| EP | 1 777 686 | A | 1/2003 |
| EP | 1 271 463 | A | 4/2007 |
| JP | 2003-285072 | A | 10/2003 |
| KR | 1020000041553 | | 7/2000 |
| KR | 1020040047558 | | 6/2004 |
| KR | 1020040076968 | | 9/2004 |
| KR | 1020050038255 | | 4/2005 |
| KR | 1020050049676 | | 5/2005 |

OTHER PUBLICATIONS

European Search Report (Application No. 07250659.5), dated Jul. 18, 2007, 10 pages.
Korean Intellectual Property Office Notice of Decision to Grant a Patent, Application No. 10-2006-0015341, dated Oct. 27, 2007, 4 pages (with English translation).

* cited by examiner

*Primary Examiner*—Nitin Patel
(74) *Attorney, Agent, or Firm*—Fish & Richardson P.C.

(57) ABSTRACT

Disclosed are a plasma display apparatus and a driving method thereof. The plasma display apparatus includes a plasma display panel having a plurality of address electrodes, a data driver, and a timing controller. The data driver supplies a plurality of data pulses to the plurality of the address electrodes and the timing controller controls a width of a first data pulse of the plurality of data pulses to be different from a width of a second data pulse of the plurality of data pulse.

18 Claims, 11 Drawing Sheets

(a)

(b)

PLASMA DISPLAY APPARATUS AND METHOD OF DRIVING THEREOF

This Nonprovisional application claims priority under 35 U.S.C. §119(a) on Patent Application No. 10-2006-0015341 filed in Korea on Feb. 16, 2006 the entire contents of which are hereby incorporated by reference.

BACKGROUND

1. Field

The present invention relates to a plasma display apparatus and a driving method thereof.

2. Background of the Related Art

Plasma display apparatus comprises a plasma display panel (PDP) having a plurality of electrodes thereon, and a driver for supplying driving signals to the plasma display panel.

The plasma display panel (PDP) generally comprises a phosphor layer formed in a plurality of discharge cells defined by barrier ribs, and a plurality of electrodes such as scan electrodes Y, sustain electrodes Z, and address electrodes X.

The driver generally supplies driving signals to the discharge cells through the electrodes.

Then, discharge is caused in the discharge cells due to a driving voltage. When the discharge is caused in the discharge cells due to the driving voltage, discharge gas in the discharge cells generates vacuum ultraviolet rays which excite the phosphor in the discharge cells, so visible light rays are emitted from the phosphor and an image can be displayed on the surface of the PDP thanks to the visible light rays.

The discharges caused in the discharge cells of the PDP comprises a reset discharge, an address discharge and a sustain discharge.

The reset discharge is to initialize all of the discharge cells, the address discharge is to select discharge cells in which the sustain discharge would be caused, and the sustain discharge is to display an image on a screen.

The address discharge is caused by a data pulse supplied to the address electrode X and a scan pulse supplied to the scan electrode.

The conventional plasma display apparatus has an disadvantageous effect in which noise and electro magnetic interference (EMI) faults are caused due to coupling between data pulses applied to adjacent address electrodes X.

SUMMARY

The present invention has been made in an effort to solve the aforementioned problems of the prior art, and provides a plasma display apparatus in which noise and EMI caused due to coupling between driving pulses upon driving a plasma display panel are reduced and a driving method thereof.

According to one aspect of the present invention, there is provided a plasma display apparatus and a driving method thereof, in which a width of a first data pulse and a second data pulse of a plurality of data pulses applied to a plurality of address electrodes are different from each other.

Implementations may include one or more of the following features. For example, a voltage changing period of the first data pulse is different from that of the second data pulse.

According to another aspect of the present invention, there is provided a method for driving a plasma display apparatus having a panel capacitor and an energy recovery circuit for charging the panel capacitor using energy charged in the panel inductor and recovering energy from the panel capacitor, the method applying a clamping voltage of a first data pulse, allowing a potential of the panel capacitor to be maintained at a constant level during a period in which the inductor is discharged, to a first address electrode of the panel capacitor and applying a clamping voltage of a second data pulse allowing a potential of the panel capacitor to be maintained at a constant level during a period in which the inductor is discharged, to a second address electrode of the panel capacitor, wherein application time points of the clamping voltages of the first data pulse and the second data pulse are different from each other.

The period in which the inductor is discharged may be a period taken until the current in the inductor is reduced to about 100 to 20% of a maximum current of the inductor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention, in which.

DETAILED DESCRIPTION OF THE PREFERRED EMBODIMENTS

Preferred embodiments of the present invention will be described in a more detailed manner with reference to the drawings.

Figure 1:
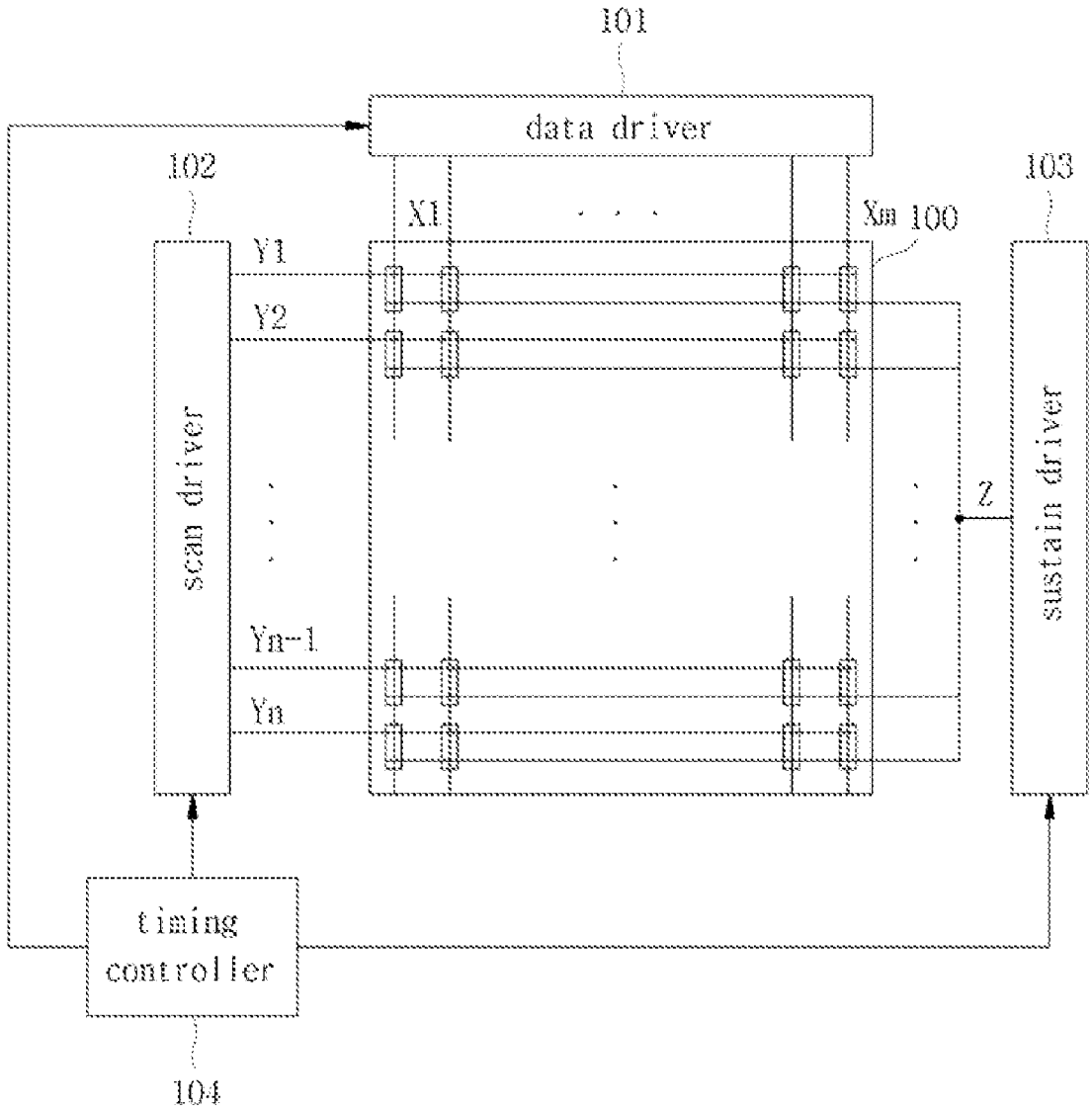
FIG. 1 is a block diagram illustrating a plasma display apparatus according to one embodiment of the present invention.

FIG. 1 illustrates a plasma display apparatus according to one embodiment of the present invention.

Referring to FIG. 1, the plasma display apparatus according to one embodiment of the present invention includes a plasma display panel 100, a data driver 101, a scan driver 102, a sustain driver 103 and a timing controller 104.

The data driver 101 supplies data pulses to respective address electrodes X of the plasma display panel 100 during an address period. In this instance, the data driver 101 is controlled by the timing controller 104 in such a manner that voltage changing periods of the data pulses to be supplied to the address electrodes X are varied.

The scan driver 102 supplies a reset pulse, a scan pulse and a sustain pulse to scan electrodes Y of the plasma display panel 100 during a reset period, an address period and a sustain period, respectively.

The sustain driver 103 supplies a sustain bias voltage Vzb and a sustain pulse to the sustain electrodes Z of the plasma display panel 100 during an address period and a sustain period, respectively.

The timing controller 104 controls respective drivers 101, 102 and 103 in such a manner that respective drivers supply driving pulses to electrodes of the plasma display panel.

The plasma display panel 100 comprises address electrodes X, scan electrodes Y and sustain electrodes Z.

Figure 2A:
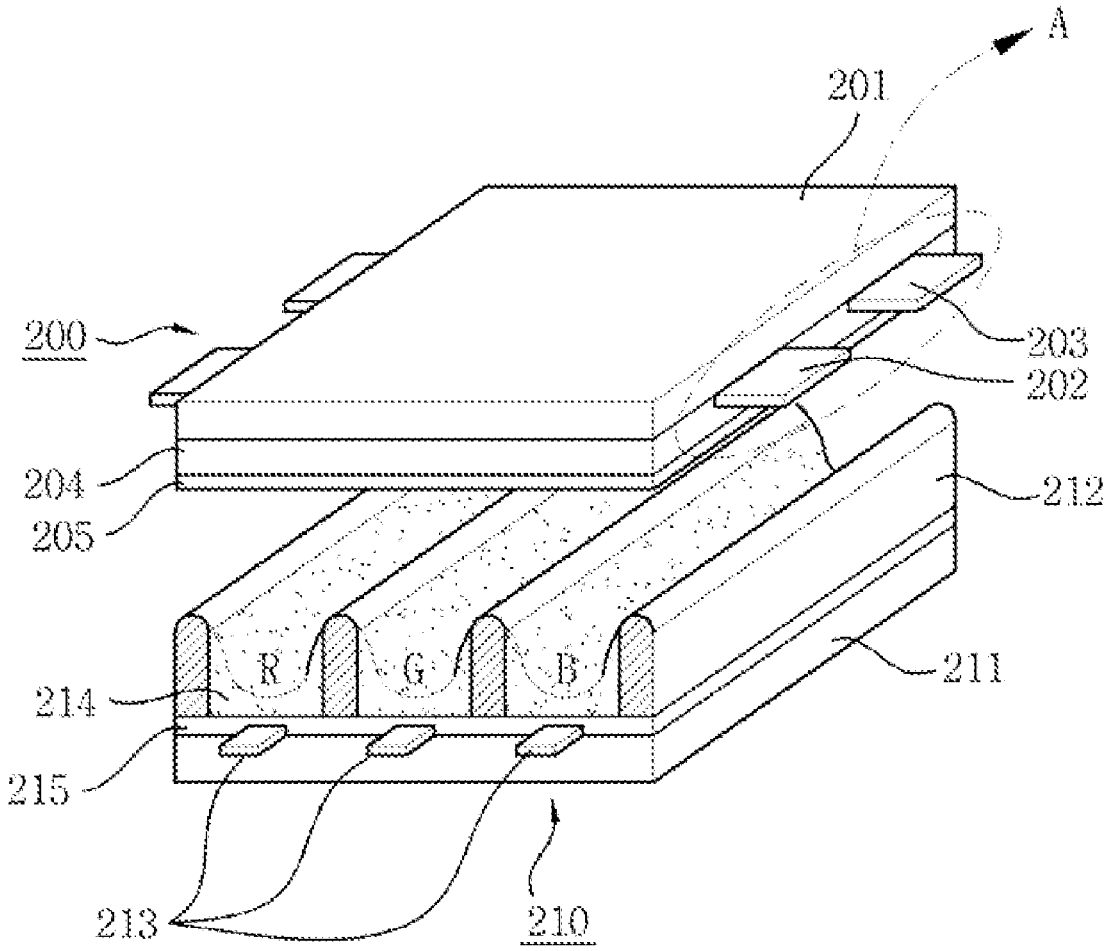
FIG. 2A and FIG. 2B are schematic perspective views illustrating a plasma display panel according to one embodiment of the present invention.
Figure 2B:
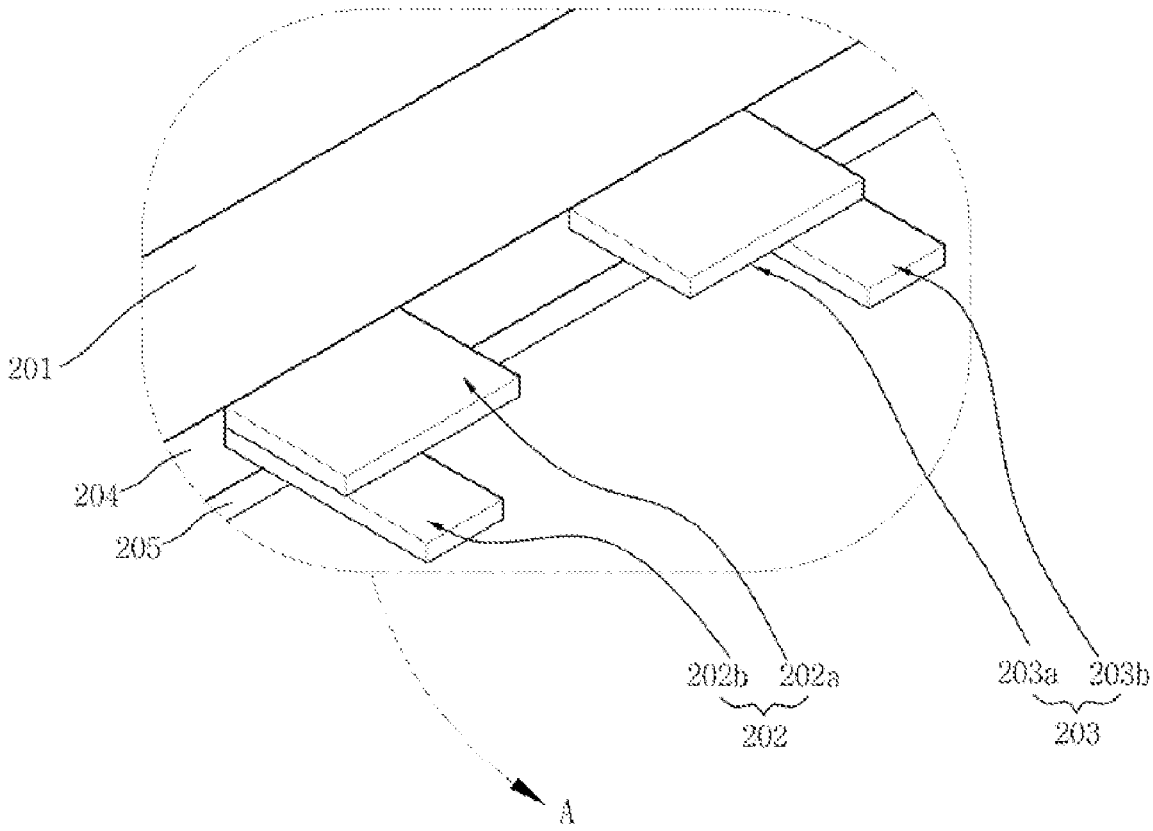

FIG. 2A and FIG. 2B schematically illustrate the structure of the plasma display panel. Referring to FIG. 2A, the plasma display panel comprises a front panel 200 having scan electrodes Y 202 and sustain electrodes Z 203 thereon and a back panel 210 having address electrodes X 213 arranged in the perpendicular direction to the scan electrodes Y 202 and the sustain electrodes Z 203. The front panel 200 and the back panel 210 are bonded to each other having a predetermined space between of both.

An upper dielectric layer 204 is formed on the upper surface of the front substrate 202 so as to cover the scan electrodes Y 202 and the sustain electrodes Z 203 disposed on the upper surface of the front substrate 202.

The upper dielectric layer 204 limits discharge current of the scan electrodes Y 202 and the sustain electrodes Z 203, and electrically insulates respective scan electrodes Y 202 from respective sustain electrodes Z 203.

A protective layer 205 is formed on the upper dielectric layer 204 in order to facilitate discharge condition. The protective layer 205 is formed through a deposition method and is generally made of magnesium oxide (MgO).

On the other hand, a lower dielectric layer 215 is formed on the upper surface of the back substrate 211 so as to cover the address electrodes X 213 disposed on the upper surface of the back substrate 211.

Further, stripe-type or well-type barrier ribs 212 are disposed on the lower dielectric layer 215 in order to define discharge cells.

The discharge cells defined by the barrier ribs 212 are filled with discharge gas, and a phosphor layer 214 to emit visible light rays is disposed in the discharge cells. For example, red R, green G and blue B phosphors are formed in the discharge cells.

Alternatively, referring to FIG. 2B, each of the scan electrode Y 202 and the sustain electrode Z 203 can be implemented by a plurality of layers.

In particular, each of the scan electrodes Y 202 and the sustain electrodes Z 203 preferably comprises a bus electrode 202*b* or 203*b* made of an opaque material such as silver Ag and a transparent electrode 202*a* or 203*a* made of a transparent material such as indium tin oxide (ITO) in order to allow light rays generated in the discharge cells to be easily emitted outside the plasma display panel and to enhance driving efficiency in the point of view of light transmittance and electric conductance.

The reason why each of the scan electrodes Y 202 and the sustain electrodes Z 203 comprises a transparent electrode 202*a* or 203*a* is that the transparent electrode 202*a* or 203*a* can effectively emit visible light rays generated in the discharge cells outside the plasma display panel.

Further, the bus electrode 202*b* or 203*b* is used to compensate low electric conductance of the transparent electrode 202*a* or 203*a* because the low electric conductance of the transparent electrode 202*a* or 203*a* may decrease driving efficiency of the plasma display panel.

The plasma display panel described above with reference to FIG. 2A and FIG. 2B is exemplarily provided. Accordingly, the structure of the plasma display panel according to the present invention is not limited thereto. For example, as shown in FIG. 2A and FIG. 2B, each of the upper dielectric layer 204 and the lower dielectric layer 215 is implemented as a single layer but at least one of the upper dielectric layer 204 and the lower dielectric layer 215 can be implemented as a multiple-layered structure.

Figure 3:
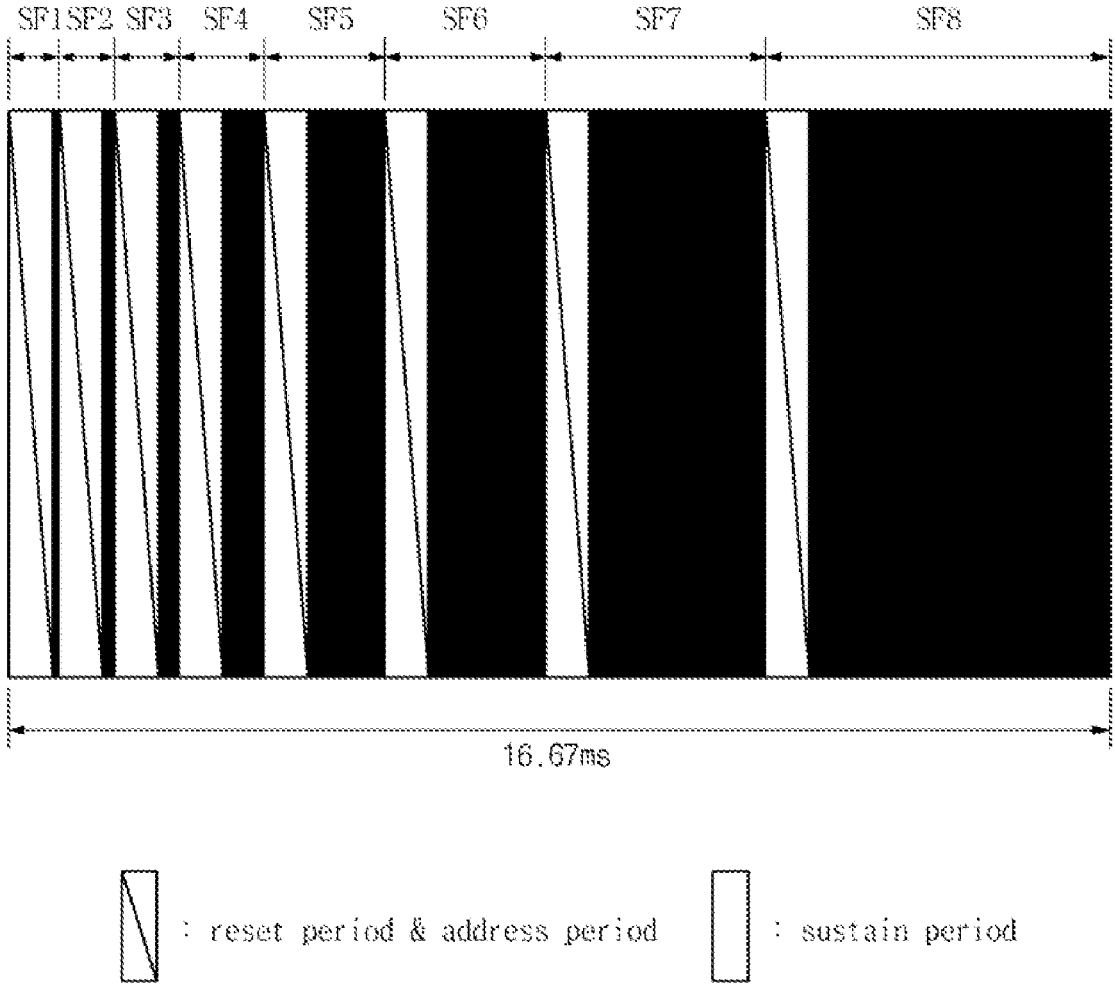
FIG. 3 is a view for explaining a gray level of an image displayed on a plasma display panel.

FIG. 3 illustrates a method of implementing the gray level of an image displayed on the plasma display panel.

Referring to FIG. 3, a single frame is divided into a plurality of subfields, in which the different numbers of times of discharges are performed in respective subfields in order to implement the gray level of an image. Each subfield is further divided into a reset period for initializing all of discharge cells in a plasma display panel, an address period for selecting discharge cells to be discharged, and a sustain period for implementing the gray level based on the number of times of discharges.

For example, as shown in FIG. 3, a frame period (16.67 milliseconds) corresponding to 1/60 seconds is divided into 8 subfields SF1, SF2, SF3, SF4, SF5, SF6, SF7, and SF8 in order to represent 256 gray levels, and each of the 8 subfields SF1, SF2, SF3, SF4, SF5, SF6, SF7, and SF8 is further divided into a reset period, an address period, and a sustain period.

In this instance, the reset periods and the address periods of respective subfields are identical, respectively, for the entire subfields, but the sustain periods of respective subfields are different from each other and are adjusted based on gray weights of respective subfields. The gray weights of the subfields can be set, for example, in such a manner that the bray weights of the subfields increase in the proportion of 2n (n=0, 1, 2, 3, 4, 5, 6, and 7), in which, for example, the gray weight of a first subfield is set to 20 and the gray weight of a second subfield is set to 21. As described above, a variety of levels of gray scale can be implemented by varying the number of sustain pulses supplied during the sustain periods of respective subfields based on the gray weights of respective subfields.

Even though one frame comprises 8 subfields in FIG. 3, the number of subfields in a single field can be diversely varied. For example, a frame can comprise 12 subfields from a first subfield through a twelfth subfield, or can comprise 10 subfields.

Further, even through the subfields are arranged in ascent order of the gray weighs of the subfields in FIG. 3, but the subfields can be arranged either in descent of the gray weighs of the gray level, or in random order of the gray weights of the gray level.

Figure 4:
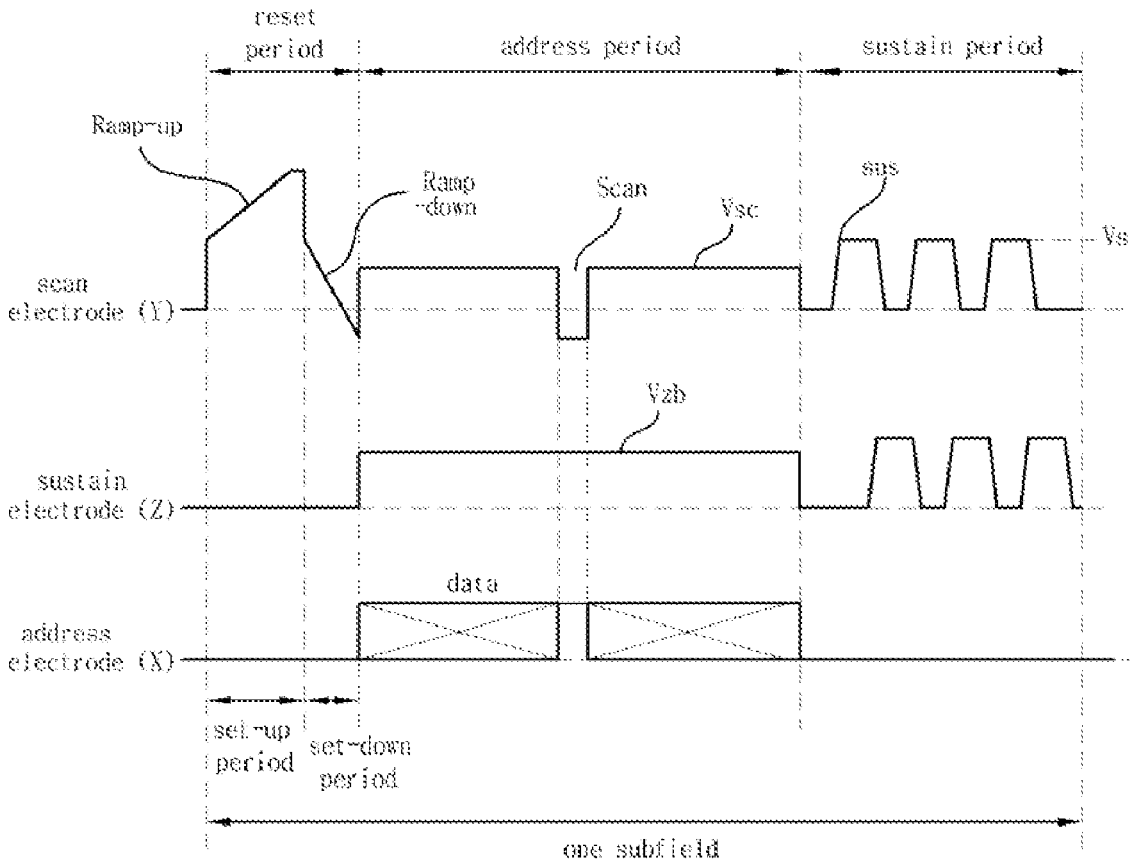
FIG. 4 is a timing diagram illustrating data pulses for explaining a plasma display apparatus driving method during any one subfield of a plurality of subfields in a frame shown in FIG. 3.

FIG. 4 illustrates a driving voltage waveform for any one of subfields for explaining a method of driving the plasma display apparatus.

Referring to FIG. 4. the scan driver 102 of the plasma display apparatus shown in FIG. 1 supplies a ramp-up waveform in which a voltage gradually rises to the scan electrode Y during a set-up period of the reset period.

The ramp-up waveform generates a set-up discharge in discharge cells, so that wall charge is accumulated in the discharge cells.

During a set-down period following the set-up period, a ramp-down waveform, in which a voltage gradually falls from a positive voltage lower than a peak voltage of the ramp-up waveform, is supplied to the scan electrode Y.

As a result, a set-down discharge is generated in the discharge cells. Thanks to the set-down discharge, the wall charge accumulated in the discharge cells due to the set-up discharge is partially erased, so that the wall charge is reduced and remains uniform in the discharge cells to the extent that the address discharge can be stably caused in the discharge cells.

The scan driver further supplies a scan reference voltage Vsc and a negative voltage −Vy of a scan pulse falling from the scan reference voltage Vsc to the scan electrode Y during the address period.

At the time when the scan driver 102 supplies the negative scan pulse voltage −Vy to the scan electrode Y, the data driver 101 supplies a data pulse voltage Vd to the address electrode X.

In order to prevent erroneous discharge which can be caused due to interference between the sustain electrodes Z during the address period, the sustain driver 103 supplies a sustain bias voltage Vzb to the sustain electrode during the address period.

As a result, during the address period, as voltage difference between the negative scan pulse voltage −Vy and the data pulse voltage Vd is added to a wall voltage resulted from the wall charge generated during the reset period, an address discharge is caused in the discharge cells to which the data pulse voltage Vd is applied.

In the discharge cells selected by the address discharge, the wall charge is generated to the extent that a discharge can be caused when a sustain voltage of the sustain pulse is supplied.

During the sustain period following the address period, the scan driver 102 and the sustain driver 103 alternately supply a sustain pulse SUS to the scan electrode Y or the sustain electrode Z.

Then, since the wall voltage in the discharge cells selected by the address discharge is added to the sustain voltage Vs of the sustain pulse SUS in the selected discharge cells, a sustain discharge is caused between the scan electrode Y and the sustain electrode Z every when the sustain pulse is supplied. As a result, an image is implemented on the plasma display panel.

Figure 5:
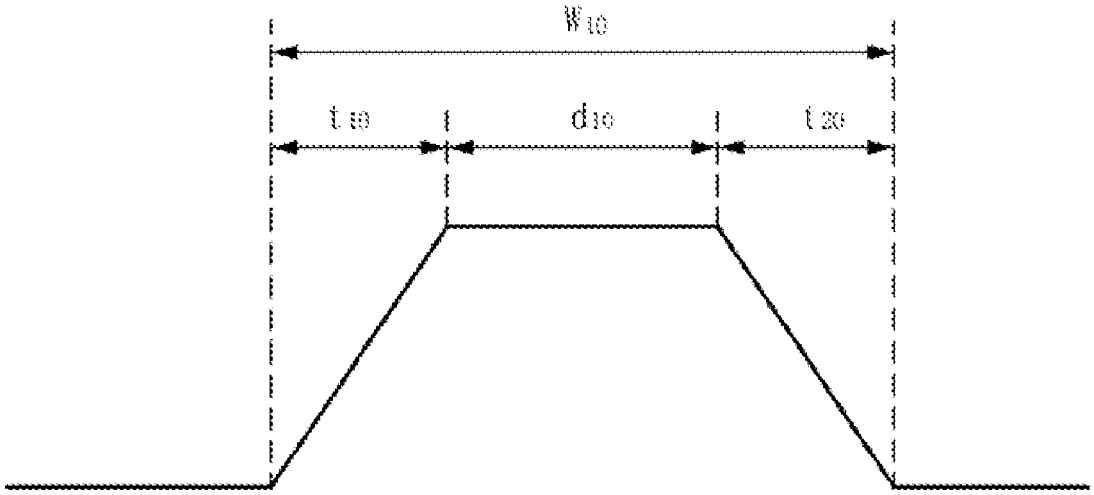
FIG. 5 is a timing diagram illustrating waveforms of data pulses supplied to an address electrode during an address period according to one embodiment of the present invention.
Figure 5:
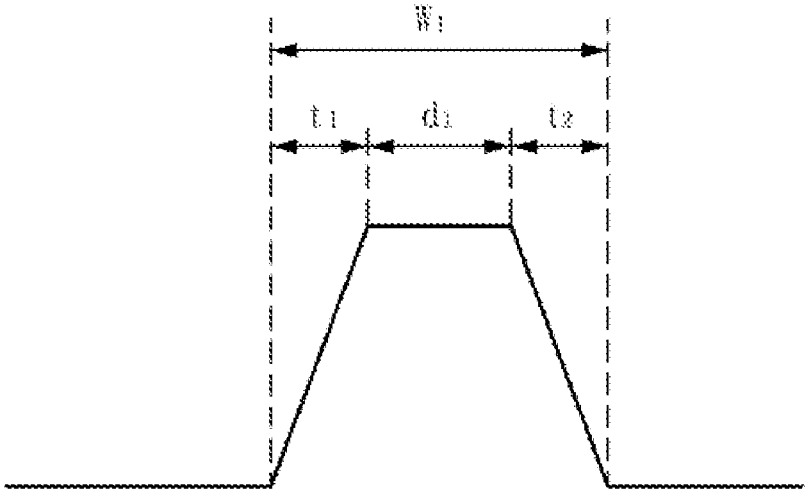

FIG. 5 illustrates a waveform of a data pulse applied to the address electrode during the address period.

Referring to FIG. 5, a first data pulse a and a second data pulse b out of data pulses supplied to a plurality of address electrodes during the address period have respective different pulse widths W10 and W1. In this case, a voltage changing period t10 and t20 and a voltage sustaining period d10 of the first data pulse can be different from the voltage changing period t1 and t2 and the voltage sustaining period d1 of the second data pulse, respectively. The voltage changing period of the first data pulse and the voltage changing period of the second data pulse can refer to either both of a rising period and a falling period of the data pulse, or only the rising period of the data pulse in order to ensure driving margin.

In the case in which the voltage changing period of the first data pulse and the voltage changing period of the second data pulse are different from each other, for example, as shown in drawings, the voltage changing period of the first data pulse is longer than the voltage changing period of the second data pulse, and a ratio of the voltage changing period of the first data pulse to the voltage changing period of the second data pulse may be preferably greater than 1 but equal to or less than 10. In such case, the driving margin of the address period can be ensured, decrease of discharge efficiency of the address discharge can be prevented and discharge uniformity is not be deteriorated.

Further, even though not shown in the drawings, when the pulse width of the first data pulse and the pulse width of the second data pulse are different from each other, the voltage sustaining period of the first data pulse and the voltage sustaining period of the second data pulse can be identical, and the voltage changing period of the first data pulse and the voltage changing period of the second data pulse can be identical.

The first data pulse and the second data pulse may be pulses supplied to adjacent address electrodes out of a plurality of address electrodes arranged on the back substrate during the address period of the same subfield.

The first data pulse and the second data pulse may be pulses supplied to the same address electrode out of a plurality of address electrodes arranged on the back substrate during the address periods of different subfields or the address periods of different frames.

As described above, when the data pulse is supplied to a plurality of address electrodes X, if the pulse width of the data pulse is adjusted, affection of coupling between adjacent data pulses is reduced, so that noise and EMI fault can be reduced.

Figure 6:
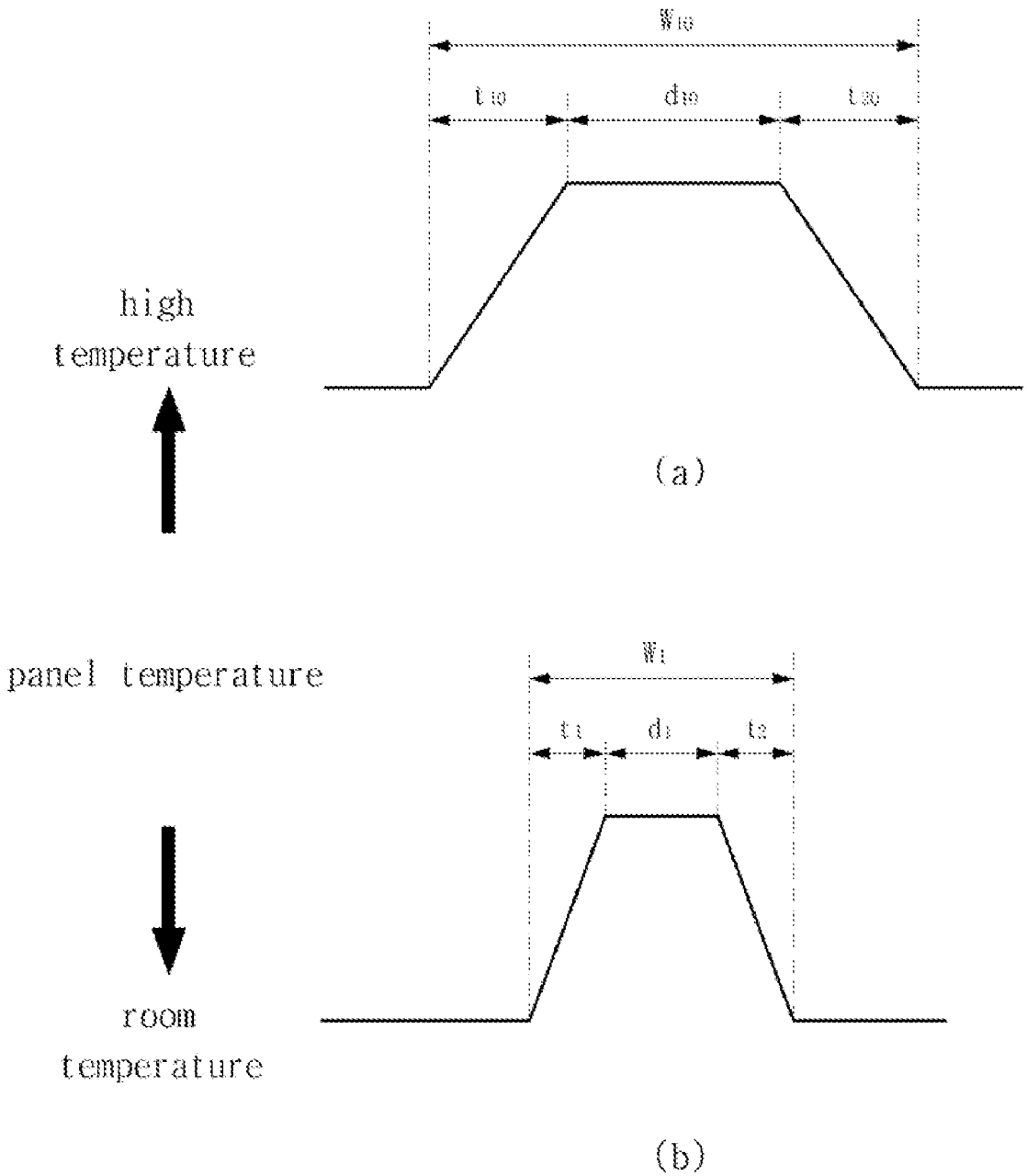
FIG. 6 is a timing diagram illustrating waveforms of data pulses, which vary based on the temperature change of a plasma display panel and are applied to a plurality of address electrodes.

FIG. 6 illustrates waveforms of data pulses supplied to a plurality of address electrodes at different panel temperatures.

Referring to FIG. 6, the pulse width of the data pulse supplied when a panel temperature of the plasma display panel is higher than a room temperature, that is, the panel temperature is high, is larger than the pulse width of the first data pulse supplied when the panel temperature is the room temperature. Further, the voltage changing period and the voltage sustaining period of the data pulse at the high temperature are also longer than those of the data pulse at the room temperature.

The reason why the pulse width of the data pulse at the high temperature is longer than that at the room temperature is that wall charge in discharge cells may not be sufficient because neutralization ratio is increased due to recombination of space charges and wall charges In the case in which the plasma display panel has the high temperature, and the insufficient wall charge can make the address discharge very weak or hinder the address discharge generation.

Accordingly, in the case in which the plasma display panel is relatively high temperature, the pulse width of the data pulse is adjusted so as to become longer than that of the data pulse supplied at the room temperature in order to compensate insufficient amount of wall charge, thereby enhancing intensity of the address discharge.

Figure 7:
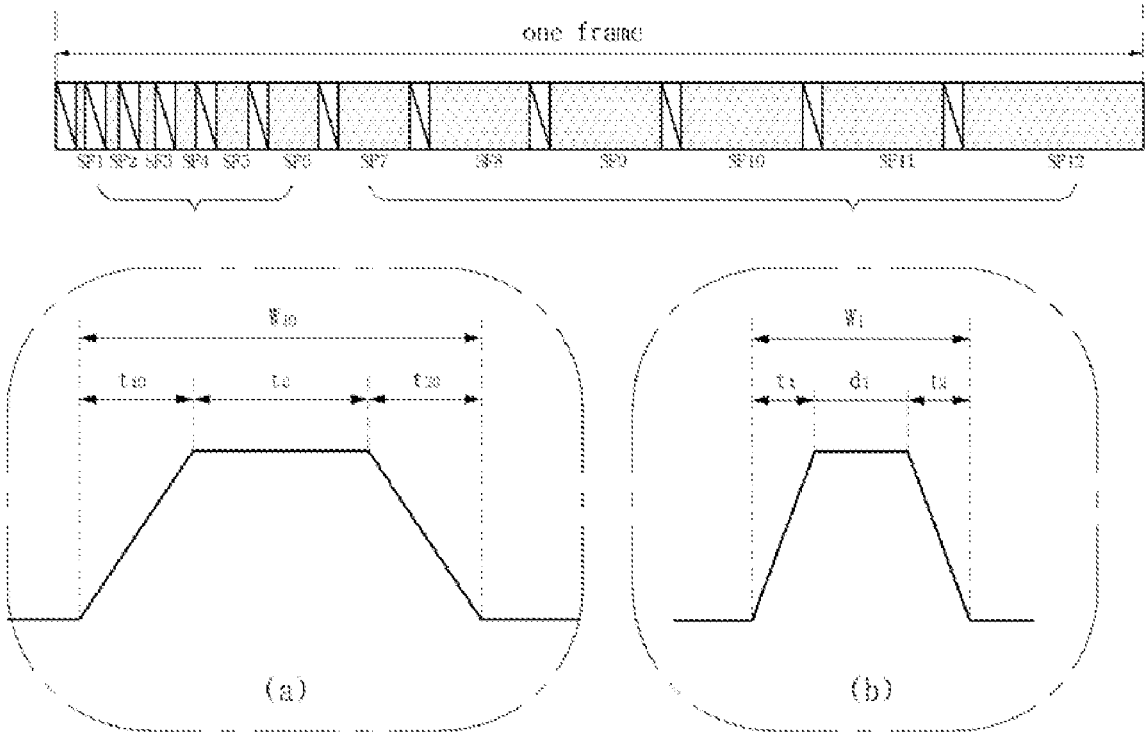
FIG. 7 is a timing diagram illustrating waveforms of data pulses applied to a plurality of address electrode, in which the waveforms of the data pulses change based on gray weights of subfields.

FIG. 7 illustrates waveforms of data pulses varying based on the gray weights of subfields, which are supplied to a plurality of address electrodes.

Referring to FIG. 7, a single frame comprises 12 subfields, and the subfields are arranged in ascent order according to the gray weights of the subfields. A width of a first data pulse supplied to a address electrode during one half of the total number of subfields belonging to one frame is larger than that of the first data pulse supplied to the address electrode during the remaining subfields. In this instance, A gray weight of one half of the total number of subfields is lower than a gray weight of the remaining subfields.

Figure 8:
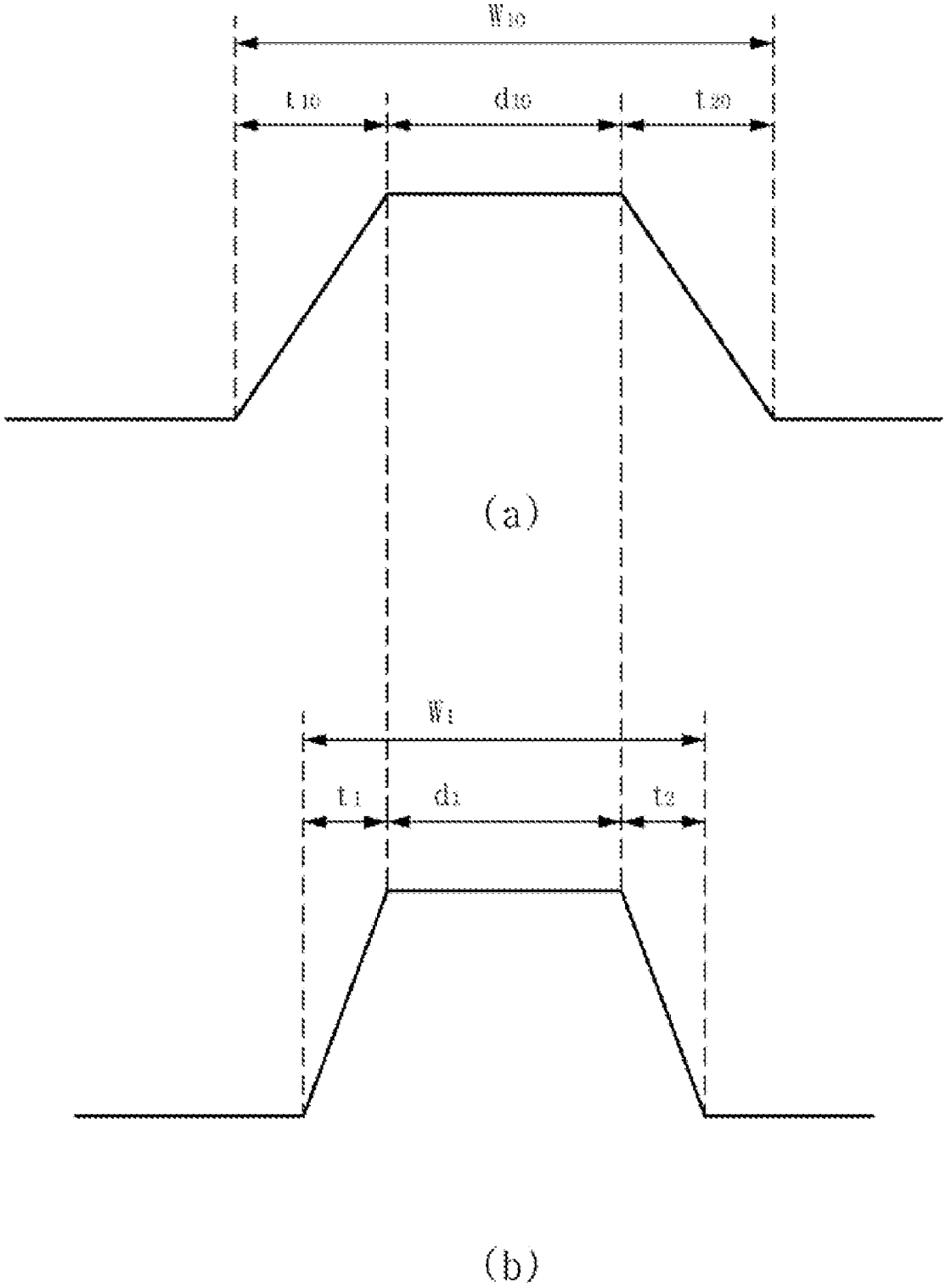
FIG. 8 is a timing diagram illustrating a modified waveform of a data pulse supplied to an address electrode during an address period according to one embodiment of the present invention.

For example, when the total number of subfields belonging to one frame is 12 subfields, a gray weights of a first through a sixth subfield are relatively lower than that of from a seventh through a twelfth subfield. In this case, the voltage sustaining periods d10, d1 of the data pulses may be identical as shown in FIG. 8. The reason whey the pulse widths of the data pulses in the subfields having relatively low gray weights is relatively larger those of the data pulses in the subfields having relatively high gray weights is that address discharge would become unstable during the subfields having relatively low gray weights out of the entire subfields because the number of sustain pulses supplied during the sustain period of the subfield having a relatively low gray weight is relatively small.

Accordingly, it is possible to make address discharge stable by increasing the pulse widths of the data pulses supplied during the subfields having relatively low gray weights.

Figure 9:
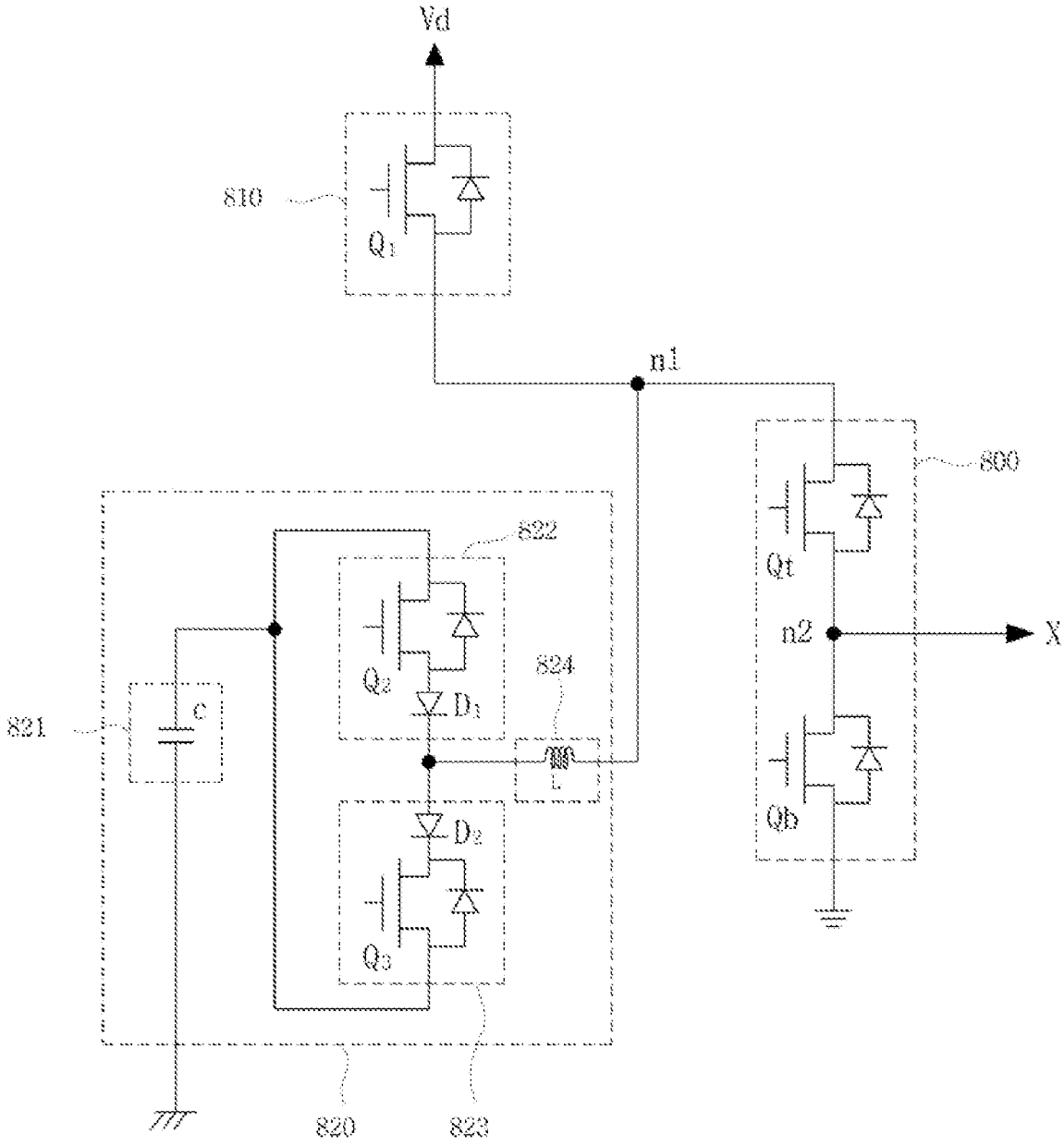
FIG. 9 is a block diagram illustrating a data driver of the plasma display apparatus according to one embodiment of the present invention.

FIG. 9 schematically illustrates the data driver of the plasma display apparatus according to one embodiment of the present invention.

Referring to FIG. 9, the data driver comprises a data drive integrated circuit 800, a data power supply controller 810 and an energy recovery circuit 820.

The data power supply controller 810 comprises a data power supply control switch Qq, which allows a data voltage Vd supplied from a data power source (not shown) to be supplied to the data drive integrated circuit 800 when it is turned on.

The data drive integrated circuit 800 is connected to an address electrode X of the plasma display panel, and supplies the voltage supplied thereto to the address electrode X through the predetermined switching operation.

The data drive integrated circuit 800 is implemented as a single module separated from the data voltage supply controller 810 and the energy recovery circuit 820. For example, the data drive integrated circuit 800 can be realized as a single chip packaged in a tape carrier package (TCP). Further, the data drive integrated circuit 800 includes a top switch Qt and a bottom switch Qb.

A first end of the top switch Qt is connected to the data power supply controller 810 and the energy recovery circuit 820, and a second end of the top switch Qt is connected to a first end of the bottom switch Qb.

A second end of the bottom switch Qb is ground GND, and a middle point (a second node n2) between the second end of the top switch Qt and the first end of the bottom switch Qb is connected to the address electrode X.

The energy recovery circuit 810 comprises an energy storage unit 821, an energy supply controller 822, an energy recovery controller 823, and an inductor 824.

Assuming that the plasma display panel is an equivalent panel capacitor, the energy recovery circuit operates in such a manner that it charges the panel capacitor using energy charged in the inductor and then recovers energy from the panel capacitor.

Figure 10:
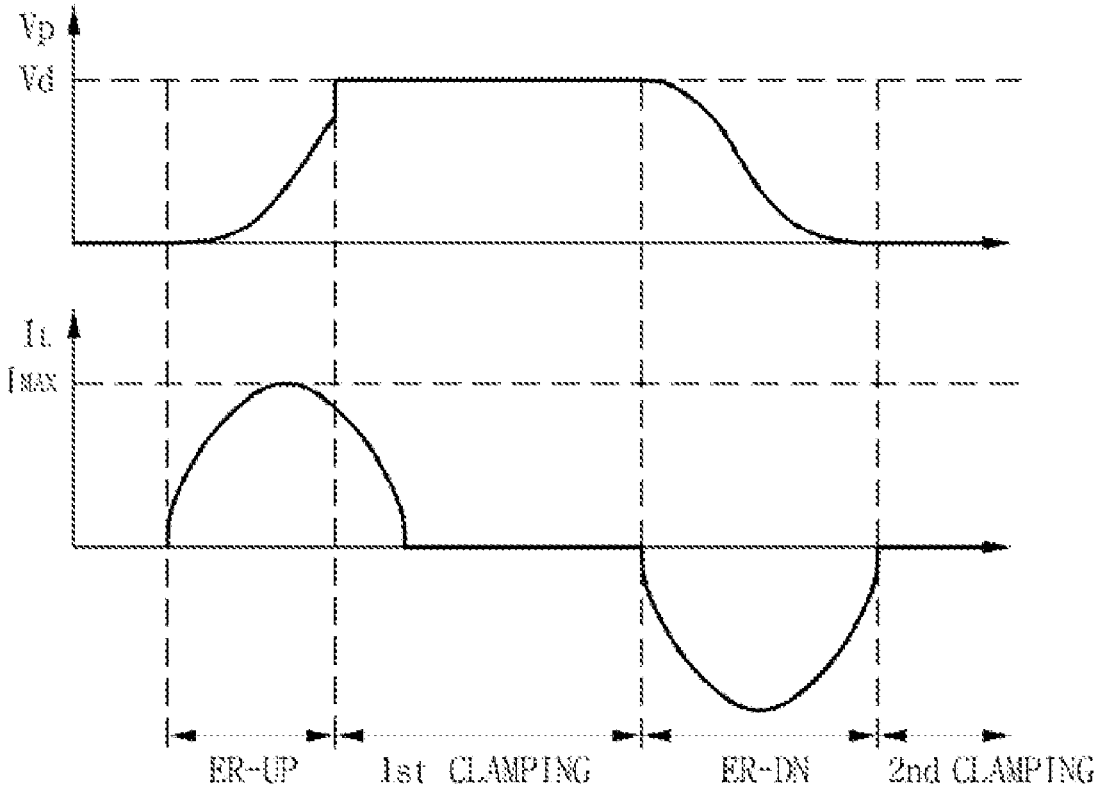
FIG. 10 is a timing diagram illustrating a method of adjusting a clamping voltage application point of the data pulse.

FIG. 10 illustrates a method of adjusting a clamping voltage application point of the data pulse using the data driver shown in FIG. 9.

Referring to FIG. 10, a second switch Q2 and the top switch Qt are turned on under the control of the timing controller shown in FIG. 1, and the turn-on state thereof is then sustained during an ER-UP period. During the ER-UP period, the first, a third and the bottom switch Q1, Q3 and Qb maintain the off state. Then, a voltage stored in the energy storage unit C is supplied to the inductor L via a first switch S1 and a first diode D1. During this time, thanks to LC resonance caused due to combination of the inductor L and the panel capacitor Cp, current IL of the inductor L is charged to a positive peak value and is then discharged, and a voltage Vp of the panel capacitor Cp is charged.

At a starting point of a first clamping period (hereinafter, referred as "clamping starting point"), the timing controller turns on the first switch Q1, whereby starting to supply the data voltage Vd to the panel capacitor Cp. During the first clamping period, the second switch Q2 maintains the off state, and the third switch Q3 and the bottom switch Qb maintain the off state. The clamping starting point comes before the current IL of the inductor L is discharged to a zero level and before the panel capacitor Cp is charged to the data potential Vd.

The clamping starting point is a discharging point when the current IL of the inductor L becomes 100 through 20% of the peak current MAX., or a charging point when the voltage Vp of the panel capacitor Vc becomes to the data potential Vd or becomes 20 to 100% of the maximum voltage. At the clamping starting point, the voltage Vp of the panel capacitor Cp abruptly rises to the data potential Vd or the peak potential. The current IL of the inductor L is discharged to a zero level by an early time of the first clamping period and then the current IL of the inductor L maintains the zero level state until the first clamping period ends.

While the voltage Vp of the panel capacitor Cp is maintained at the peak potential, address discharge is caused in discharge cells.

As described above, according to the energy recovery apparatus and the clamping method according to one embodiment of the present invention, the voltage of the panel capacitor Cp is clamped to the peak potential at the clamping starting point, whereby reducing the ER-UP period. As a result, it is possible to vary application timing points of the clamping voltages of the data pulses according to the change of temperatures. Such scheme is described above yet, repetitive description thereof will be omitted herein.

After the first clamping period, the first switch Q1, the second switch Q2 and the bottom switch Qb are turned off, and the third switch Q3 is turned on. Then, the on state of the third switch Q3 is maintained during an ER-DN period. As a result, reactive power in the panel capacitor, which is not contributed to the discharge, is recovered to the energy storage unit C via the inductor L, the second diode D2 and the third switch Q3. During the ER-DN period, current IL of the inductor L is charged to a negative peak due to charge from the panel capacitor Cp, and is then discharged to a zero level, and the voltage Vp of the panel capacitor Cp is discharged to a ground level GND from the data potential Vd. At the ending of the DR-DN period, if current of the inductor L becomes zero, the third switch Q3 is turned off and the bottom switch Qb is turned on. The on-state of the bottom switch Qb is maintained during a second clamping period. During the second clamping period, the first switch Q1 and the top switch Qt maintains off-state, and a ground voltage GND is supplied to the panel capacitor Cp via the bottom switch Qb. Accordingly, the voltage Vp of the panel capacitor Cp is maintained at the constant level, the ground level GND.

As described above, it is possible to vary the voltage changing period and the voltage sustaining period of the data pulse supplied to the address electrode X of the panel capacitor by adjusting the switching timing of the switches of the data driver.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel including address electrodes;

a data driver for supplying a first data pulse in a first set of subfields belonging to a frame and a second data pulse in a second set of subfields belonging to the frame to the address electrodes, the first data pulse and the second data pulse each comprising a voltage changing period and a voltage sustaining period; and a timing controller for controlling the voltage changing period of the first data pulse to be longer than the voltage changing period of the second data pulse.

2. The plasma display apparatus according to claim 1, wherein the voltage changing period is a rising time of the data pulse.

3. The plasma display apparatus according to claim 1, wherein a voltage sustaining period of the first data pulse is substantially identical to a voltage sustaining period of the second data pulse.

4. The plasma display apparatus according to claim 1, wherein the voltage changing period of the first data pulse is longer when a temperature of the plasma display panel is higher than a room temperature than the voltage changing period of the first data pulse when the temperature of the plasma display panel is equal to the room temperature.

5. The plasma display apparatus according to claim 1, wherein a width of the first data pulse and a width of a third data pulse belonging to the same subfield are different from each other.

6. The plasma display apparatus according to claim 1, wherein a pulse width of the first data pulse and a pulse width of a third data pulse respectively belonging to different subfields are different from each other.

7. The plasma display apparatus according to claim 1, wherein a pulse width of the first data pulse and a pulse width of a third data pulse belonging to a second frame are different from each other.

8. The plasma display apparatus according to claim 1, wherein a gray weight of the second set of subfields is higher than the gray weight of the first set of subfields.

9. The plasma display apparatus according to claim 1, wherein the total number subfields included in the frame is N, and the total number of subfields included in the first set of subfields is N/2.

10. A method of driving a plasma display apparatus, the plasma display apparatus including a panel capacitor and an energy recovery circuit which charges the panel capacitor using energy charged in an inductor and recovers the energy from the panel capacitor, the method comprising:

supplying a clamping voltage of a first data pulse to a first address electrode of the panel capacitor, the clamping voltage allowing a potential of the panel capacitor to maintain a constant level during a period in which current of the inductor is discharged;

supplying a clamping voltage of a second data pulse to a second address electrode of the panel capacitor, the clamping voltage allowing a potential of the panel capacitor to maintain a constant level during a period in which current of the inductor is discharged; and wherein the clamping voltage of the first data pulse is applied at a first time and the clamping voltage of the second data pulse is applied at a second time that is different than the first time.

11. The method according to claim 10, wherein the period in which current of the inductor is discharged is a period that begins with the current of the inductor at a maximum and that continues until the current of the inductor reaches 20% of the maximum current of the inductor.

12. The method according to claim 10, wherein the period in which the current of the inductor is discharged is a period that begins with the voltage of the panel capacitor at 20% of a maximum and that continues until a voltage of the panel capacitor reaches the maximum voltage of the panel capacitor.

13. The method according to claim 10, wherein the clamping voltage of the first data pulse is applied to the address electrode of the panel capacitor earlier when a temperature of the panel capacitor is higher than a room temperature than the clamping voltage of the first data pulse supplied to the address electrode of the panel capacitor when the temperature of the panel capacitor is equal to the room temperature.

14. The method according to claim 10, wherein a duration of a sustaining period of the clamping voltage of the first data pulse is different from a duration of a sustaining period of the clamping voltage of the second data pulse.

15. The method according to claim 10, wherein a duration of a voltage changing period of the first data pulse is different from a duration of a voltage changing period of the second data pulse.

16. A driving method of a plasma display apparatus displaying an image by combination of one or more subfields, comprising:

supplying a first data pulse during a first set of subfields belonging to a frame to a first address electrode during address periods of the subfields; and supplying a second data pulse during a second set of subfields belonging to the frame to a second address electrode during address periods of the subfields, wherein the first data pulse and the second data pulse each include a voltage changing period and a voltage sustaining period, and wherein a duration of the voltage changing period of the first data pulse is longer than a duration of the voltage changing period of the second data pulse.

17. The method according to claim 16, wherein a gray weight of the second set of subfields is higher than the gray weight of the first set of subfields.

18. The method according to claim 16, wherein the total number subfields included in the frame is N, and the total number of subfields included in the first set of subfields is N/2.

* * * * *